US005931238A

United States Patent [19]

Gilmore et al.

[11] Patent Number: 5,931,238

[45] Date of Patent: Aug. 3, 1999

[54] APPARATUS FOR STORING AND HANDLING DRILL PIPE

[75] Inventors: Carl D. Gilmore, South Milwaukee; Calvin E. Stuckemeyer, Greendale, both of Wis.

[73] Assignee: Bucyrus International, Inc., South Milwaukee, Wis.

[21] Appl. No.: 08/881,336

[22] Filed: Jun. 24, 1997

Related U.S. Application Data

[60] Provisional application No. 60/020,841, Jun. 28, 1996.

[51] Int. Cl.[6] ..... E21B 19/20

[52] U.S. Cl. ..... 175/52; 175/85; 414/22.56; 414/22.62

[58] Field of Search ..... 175/52, 85; 414/22.54, 414/22.55, 22.56, 22.62

[56] References Cited

U.S. PATENT DOCUMENTS

| | | | |
|---|---|---|---|
| 3,212,593 | 10/1965 | Reischl | 175/85 |
| 3,493,061 | 2/1970 | Gyongyosi | 175/85 |
| 3,734,208 | 5/1973 | Otto | 175/52 |
| 3,860,126 | 1/1975 | Neimark et al. | 214/2.5 |
| 3,985,189 | 10/1976 | Jahnke et al. | 175/52 |
| 4,547,110 | 10/1985 | Davison | 414/22.55 |
| 4,591,006 | 5/1986 | Hutchison | 175/52 |
| 4,595,066 | 6/1986 | Neimark et al. | 175/85 |
| 5,458,454 | 10/1995 | Sorokan | 175/85 |
| 5,622,232 | 4/1997 | Whisenhunt | 175/85 |

FOREIGN PATENT DOCUMENTS

| | | | |
|---|---|---|---|
| 0182500 | 5/1986 | European Pat. Off. | 175/52 |

*Primary Examiner*—David J. Bagnell
*Assistant Examiner*—Chi H. Kang
*Attorney, Agent, or Firm*—Quarles & Brady

[57] ABSTRACT

A blast hole drill with a drill head mounted on a mast has a pipe carousel on the drill deck which holds drill pipe along the length of the deck. A pipe handling arm mechanism has a lower arm portion pivotally mounted on the deck and an upper arm portion pivotally mounted to the lower arm portion. The upper arm portion has jaws that grasp a drill pipe. A ram connected to the upper arm portion pivots the arm mechanism until the lower arm portion engages a stop adjacent the mast. The ram thereafter continues to pivot the upper arm portion until a drill pipe carried thereby is aligned on the mast.

10 Claims, 7 Drawing Sheets

APPARATUS FOR STORING AND HANDLING DRILL PIPE

This application claims the benefit of U.S. Provisional Application No. 60/020,841 filed Jun. 28, 1996.

BACKGROUND OF THE INVENTION

This invention relates to mobile earth drilling units, and particularly to an apparatus for storing and handling lengths of drill pipe to be connected in a drill string for drilling operations.

A type of drilling unit known as a blast hole drill is used in surface mining and quarrying operations. The unit is typically mobile, being mounted on a vehicle that travels on tractor crawlers. A long, pivoting mast is carried horizontally when the unit is on the move, and is set upright or at a slight angle from upright (i.e. within 30° of vertical) for drilling.

Lengths of drill pipe are typically stored within the mast. The drill pipes are each stored in pipe handling mechanisms which can move a drill pipe from a storage position to a position where it can be added to the drill string. Examples of the mast storage of drill pipes are found in U.S. Pat. Nos. 3,212,593 to Reischel issued Oct. 19, 1965, 3,860,126 to Neimark, et al. issued Jan. 14, 1975, and 4,595,066 to Neimark, et al. issued Jun. 17, 1986. It has also been proposed to mount a carousel along the length of the mast, with the carousel holding multiple drill pipes. The carousel is rotatable and movable into a position where a drill pipe can be added or removed from the drill string. An example of this approach is shown in U.S. Pat. No. 3,985,189 to Jahnke, et al. issued Oct. 12, 1976.

In a well drilling unit, it has been proposed to store drill pipe segments and drill casing segments horizontally in a rack on the side of the drill unit. The drill pipes and casings are fed by gravity to a position in which they can be gripped by an arm to be raised to a vertical position for adding to the drill strings. An example of this approach is shown in U.S. Pat. No. 3,734,208 to Otto issued May 22, 1973.

SUMMARY OF THE INVENTION

In accordance with the invention, a drill pipe carousel is mounted along the length of the deck of a drill unit. The carousel is indexable to position a drill pipe at a handling station where the drill pipe will be engageable by jaws of a pipe handling arm. The pipe handling arm is pivotally attached to the deck and can be raised to carry a drill pipe held by the arm to a position on the mast where the drill pipe can be engaged by a rotary drill head. Drill pipes can be removed from a drill string and replaced in the carousel by reversing the operation.

Preferably, the pipe handling arm comprises a lower arm portion pivotally connected to the deck and an upper arm portion pivotally connected to the lower arm portion. The pipe handling arm is first pivoted through an arc until the lower arm portion engages a bumper on the mast support near the mast pivot. The upper arm portion is then pivoted through a further arc until it is fully engaged with the mast to thereby ensure that the drill pipe carried by the arm is aligned with the longitudinal axis of the mast.

The pipe handling arm is preferably a hydraulically-actuated mechanical linkage. A ram extending between the deck and the upper arm portion raises and lowers the arm. Tensioning means between the lower and upper arm portions allows the arm to position a drill pipe anywhere from before vertical to past vertical. A clamping system including clamp jaws, attached to the upper arm portion, retain the drill pipe in the handling arm for transport from the carousel, into the mast, and back again. Lower clamp jaws can also incorporate a breakout pawl to facilitate the loosening of the upper threaded connection of the drill pipe to the rotary drive of the drill head. The pipe handling arm functions to properly position the pipe whether the mast is vertical or at an angle from vertical.

It is a principal object of the invention to provide an improved drill pipe storage and handling apparatus for blast hole drills.

It is a further object of the invention to provide a storage mechanism that allows the drill pipe to be stored on the drill deck instead of in the mast.

Storing drill pipe on the drill deck results in a lower center of gravity for the drilling operation. With a lower center of gravity, the drill has improved stability while traversing on slopes. The loads imposed on the mast structure are reduced because the weight of the stored drill pipe and carousel is carried by the main frame instead of by the mast structure. Productivity can be increased by allowing the drill unit to propel faster between holes and on steeper slopes.

The foregoing and other objects and advantages of the invention will appear in the following detailed description. In the description, reference is made to the accompanying drawings which illustrate a preferred embodiment of the invention.

DETAILED DESCRIPTION OF THE PREFERRED EMBODIMENT

Figure 1:
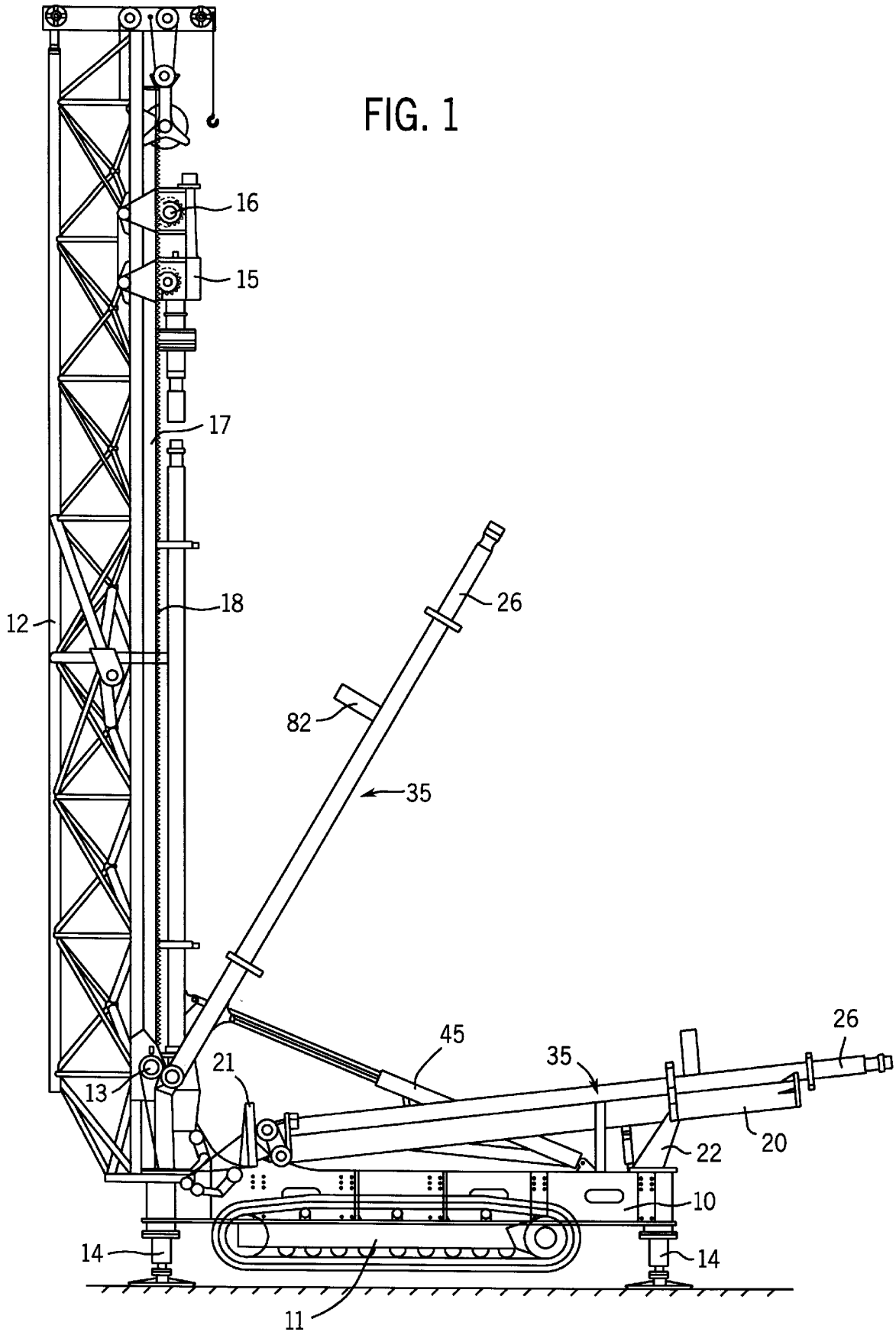
FIG. 1 is a side view in elevation of a mobile blast hole drill unit incorporating the present invention.

The invention is primarily adapted for use on a blast hole drill unit. As shown in FIGS. I and 2, a blast hole drill typically will include a main deck frame 10 supported on crawler tractors 11 and mounting a mast 12 supported on a pivot 13 attached to the deck 10. During drilling operation, the drill unit is supported on jacks 14. A rotary drill head 15 is mounted on a pull-down mechanism 16 on the mast 12. The pull-down mechanism 16 travels up and down the side cords 17 of the mast 12 on a rack of teeth 18. The drill head 15 includes a rotary drive which engages with the top of a drill string to rotate the bit. The drill head 15 is moved down the mast 12 to force the bit into the earth and is moved up the mast to withdraw the drill string from the earth. The mast is the subject of a commonly owned U.S. Provisional Patent Application No. 60/020,856 filed Jun. 28, 1996, for "Tubular Drill Mast".

A pipe carousel includes a round tube 20. The tube 20 is rotatably attached on its foot to a pedestal 21 which rises from the deck 10 adjacent the mast. The tube 20 rests in a cradle 22 that rises from the front of the deck 10. As shown particularly in FIG. 2, scalloped plates 25 are mounted on the perimeter of the tube 20 at the top and bottom of the tube 20, The scalloped plates 25 contain pockets in the perimeter which hold drill pipes 26. Although the plates 25 illustrated in the drawings are shown holding three lengths of drill pipes, the same size carousel can be adapted to hold up to five smaller drill pipes by replacing the scalloped plates 25 with a similar plate but having more pockets.

Figure 2:
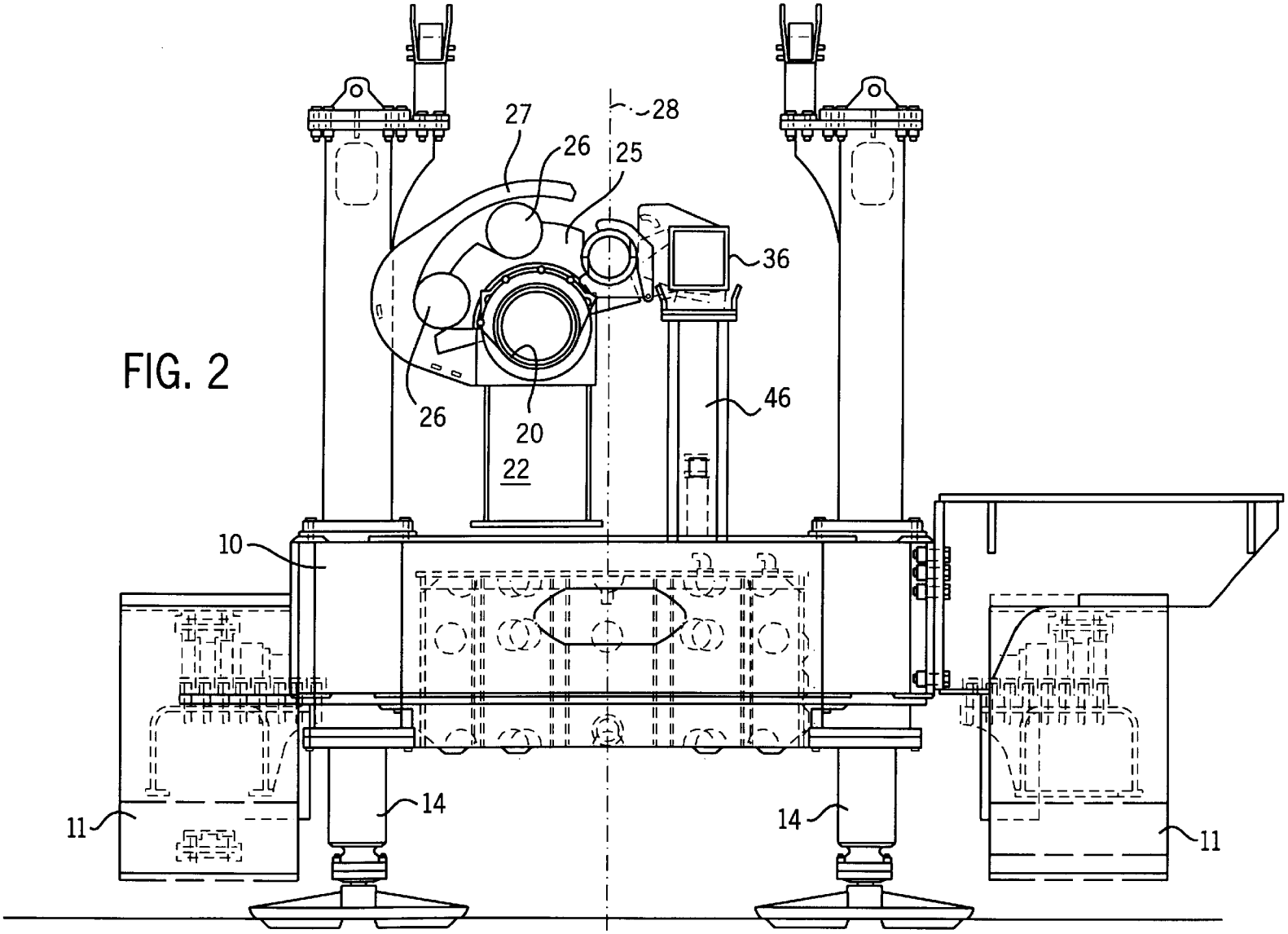
FIG. 2 is a front view in elevation of the drill unit of FIG. 1 to an enlarged scale.
Figure 3:
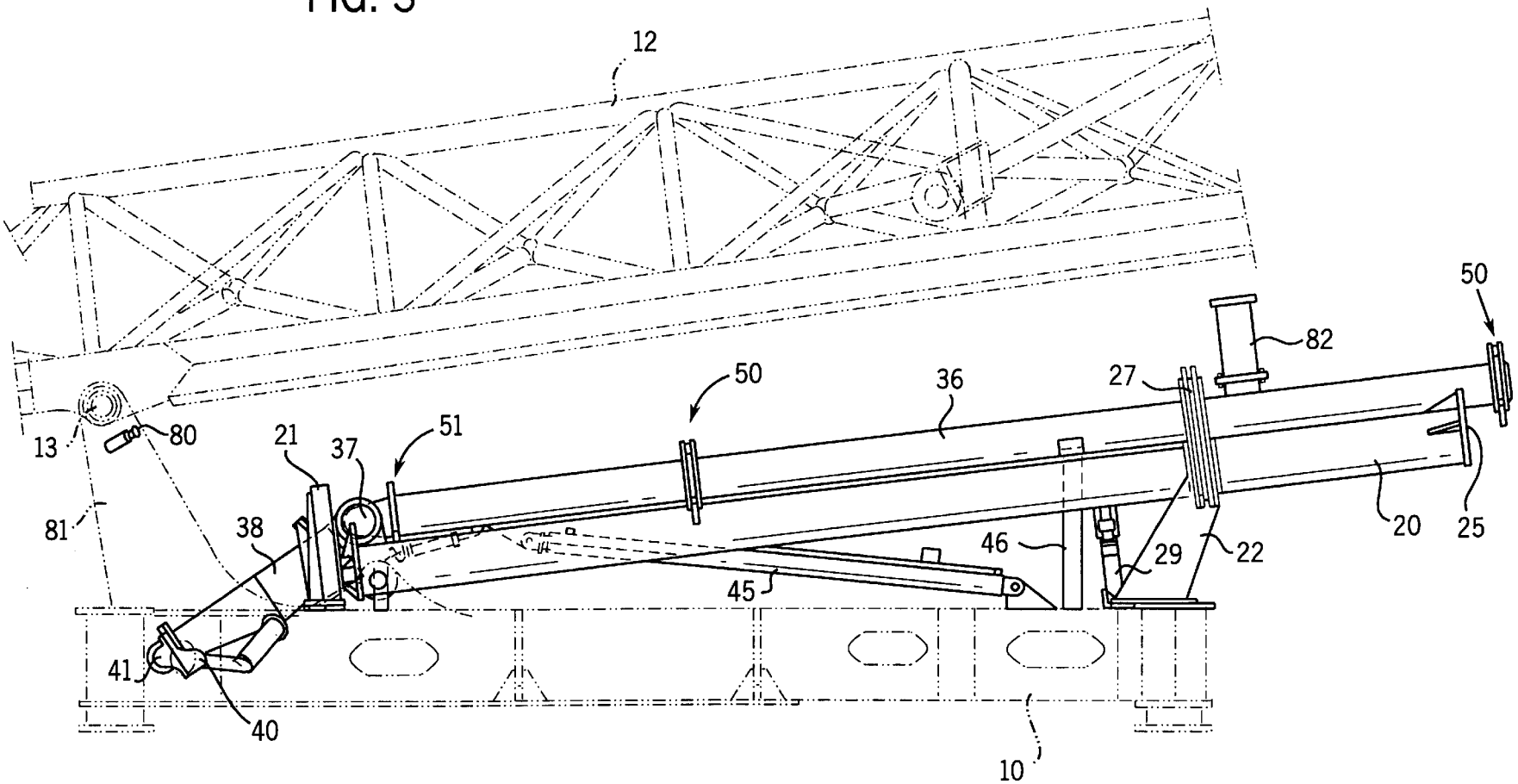
FIG. 3 is a side view in elevation of the drill pipe carousel and handling arm with portions of the drill unit shown in phantom lines.
Figure 4:
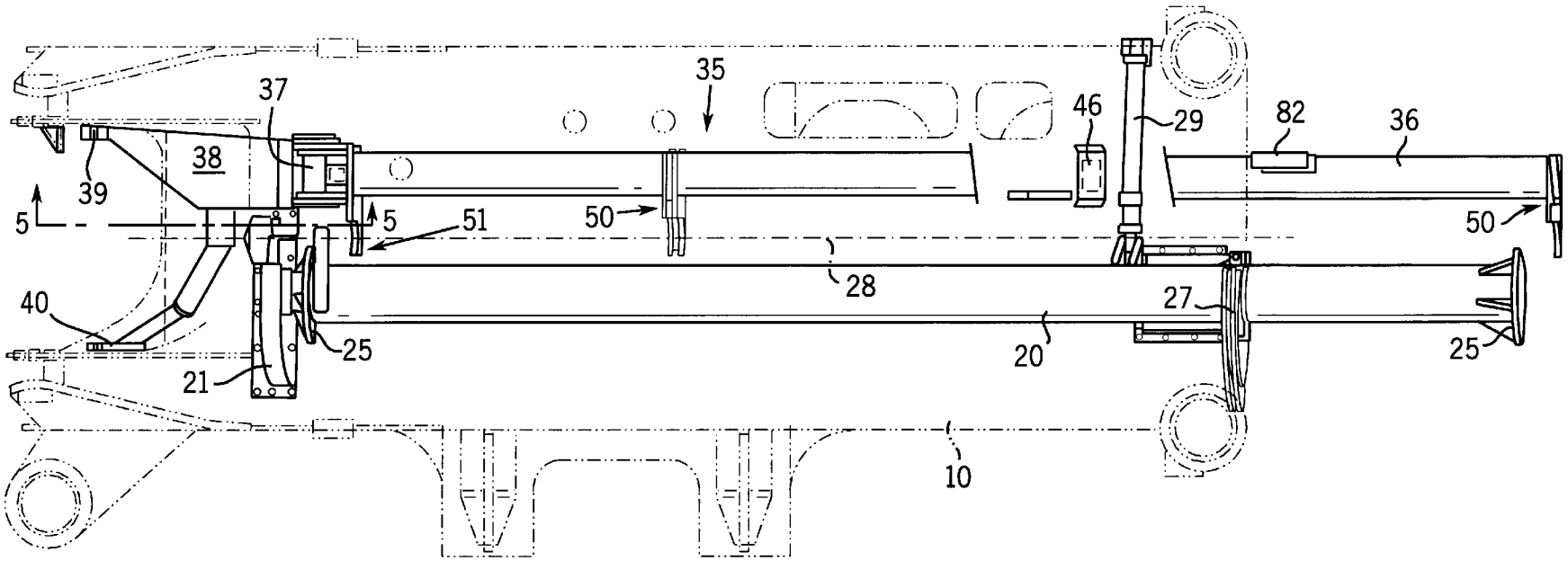
FIG. 4 is a top plan view of the carousel and handling arm of FIG. 3.
Figure 5:
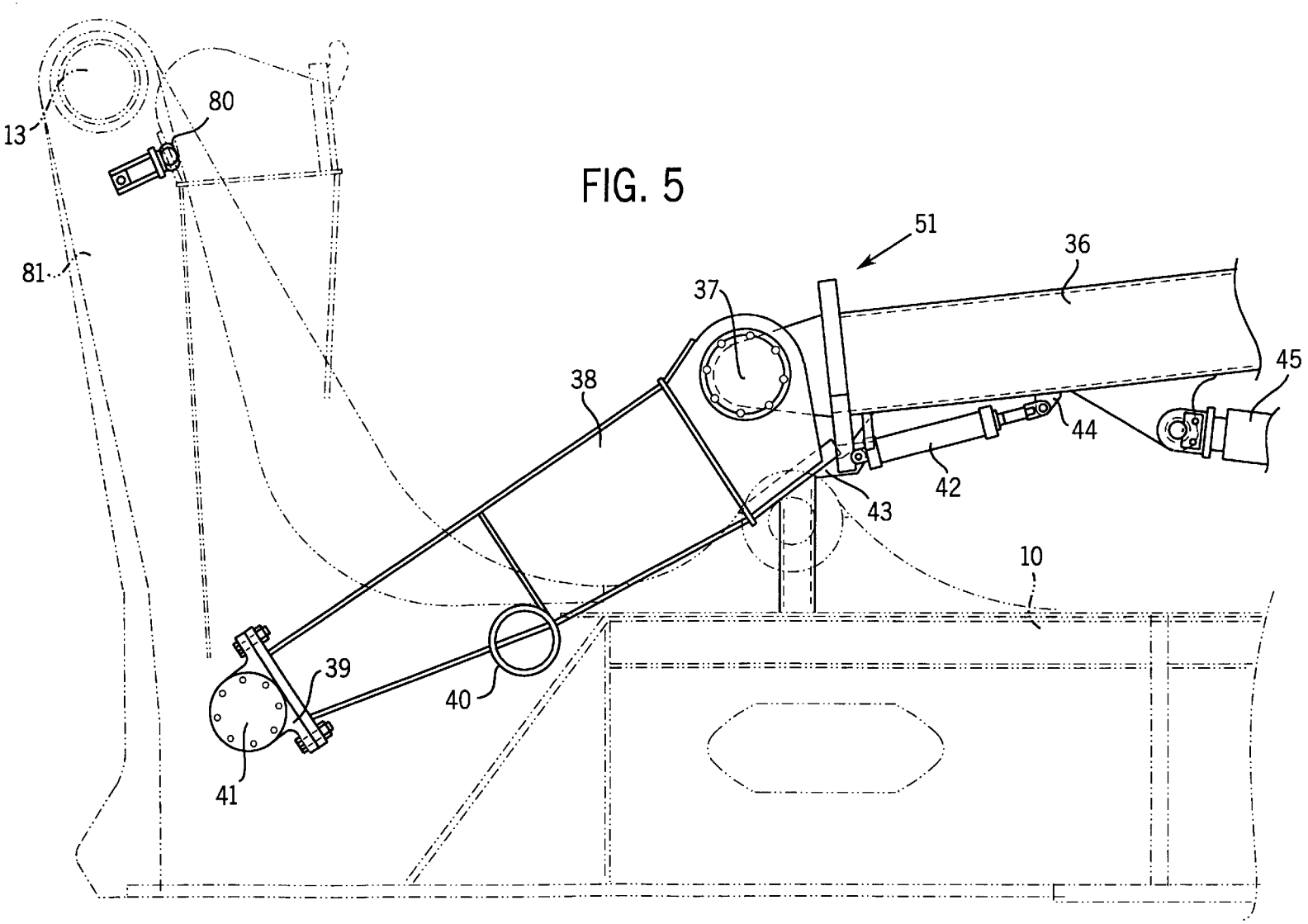
FIG. 5 is an enlarged view of a portion of the lower arm portion of the tool handling arm taken in the plane of the line 5—5 in FIG. 4.

As shown in FIG. 2, a shroud member 27 extends over the drill pipe 26 contained in the scalloped plates 25 so that only one drill pipe 26 that is at the approximate centerline 28 of the drill unit is free of the shroud 27. The carousel tube 20 is indexable to present any one of the pockets in the plates 25 to the centerline 28. Indexing is accomplished by a hydraulic cylinder 29 that is connected between the carousel tube 20 and the deck 10.

A drill pipe that is in the pipe handling position at the centerline 28 of the drill unit can be gripped by a pipe handling arm indicated generally by the numeral 35. The arm 35 includes an upper square tubular arm portion 36 that is connected at its foot to an intermediate pivot 37. The intermediate pivot 37 is attached to the upper end of a lower arm assembly 38 which is formed with two clevis portions 39 and 40 that are connected at pivots 41 to the rear portion of the main deck 10. The clevis portion 39 is a simple extension of the lower arm 38 fabrication. The clevis 40 is formed at the end of a tubular assembly shaped to clear equipment on the lower end of the mast 12. The upper arm portion 36 and the lower arm assembly 38 are joined by a small hydraulic cylinder 42 that extends between a bracket 43 mounted on the underside of the lower arm assembly 38 and a bracket 44 mounted on the underside of the upper arm portion 36.

The pipe handling arm 35 is moveable between a raised position and a lowered position by a long hydraulic ram 45. When the arm 35 is in its lowered position, the upper arm portion 36 rests on a stanchion 46.

Figure 6:
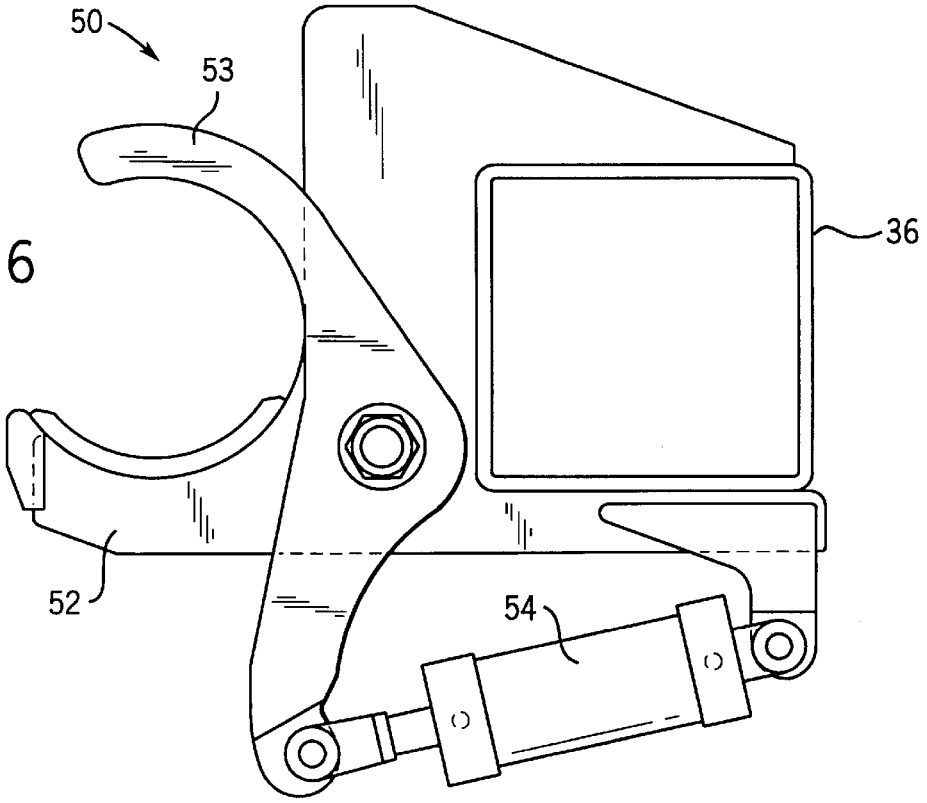
FIG. 6 is a view in elevation and partly in section of a jaw mechanism for the handling arm.
Figure 7:
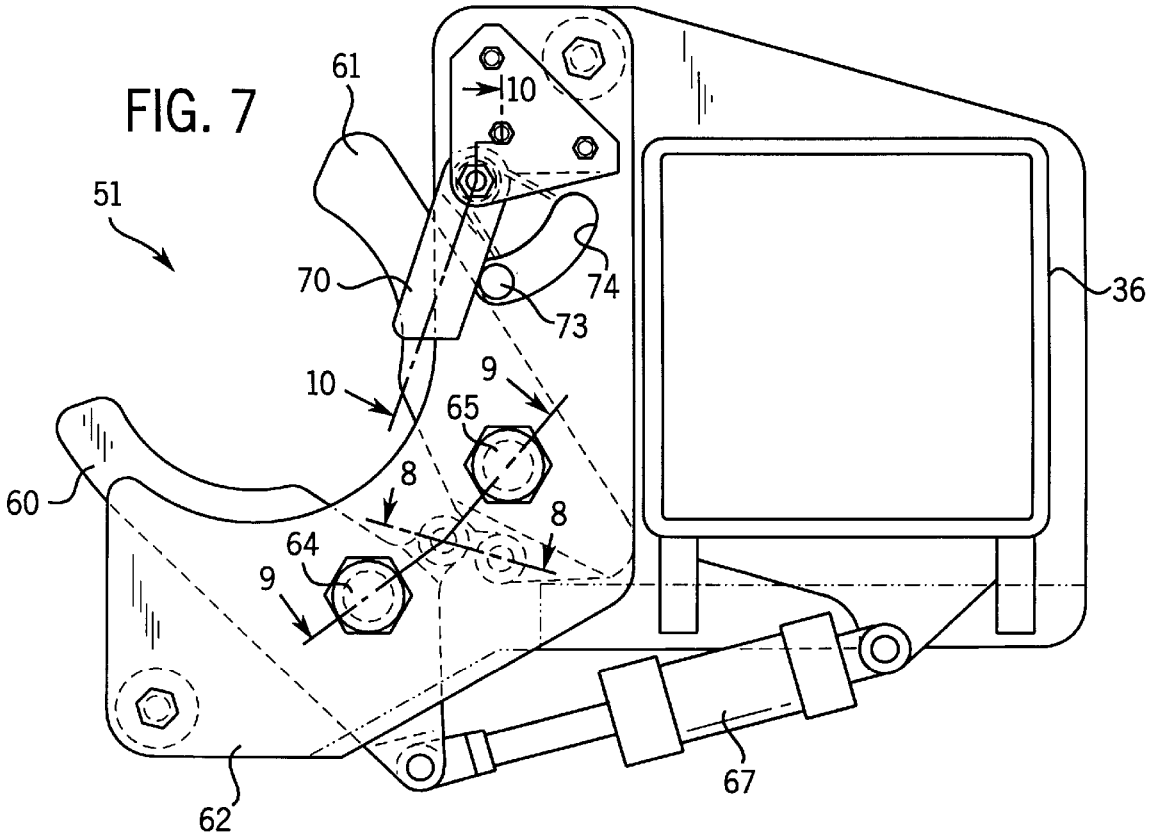
FIG. 7 is a view in elevation and partially in section of a second jaw mechanism for the handling arm which includes a pawl.

The upper arm tube 36 carries jaw assemblies for grasping a drill pipe that is located within the carousel in the handling station at the centerline of the drill unit. The jaw assemblies are of two types. A single jaw assembly, indicated generally by the reference numeral 50, is shown in FIG. 6. Such single jaw assemblies 50 are located at the outer end of the upper arm tube 36 and about a third of the way along the tube 36 measured from the intermediate pivot 37. A double jaw assembly (see FIG. 7), indicated generally by the reference numeral 51, is mounted on the tube 36 just above the intermediate pivot 37.

The single jaw assembly 50 has a fixed lower jaw 52 extending from a side of the tube 36. A moveable clamp member 53 is pivoted to the fixed jaw 52 and moved between an extended and retracted position by a hydraulic cylinder 54. As shown in FIG. 2, when the pipe handling arm 35 is at its lowered position, a drill pipe 26 in the carousel 20 at the centerline 28 of the drill unit will rest in the lower jaws 52 of the two single jaw assemblies 50. Closing the clamp 53 will, of course, lock the drill pipe 26 to the arm 35.

Figure 8:
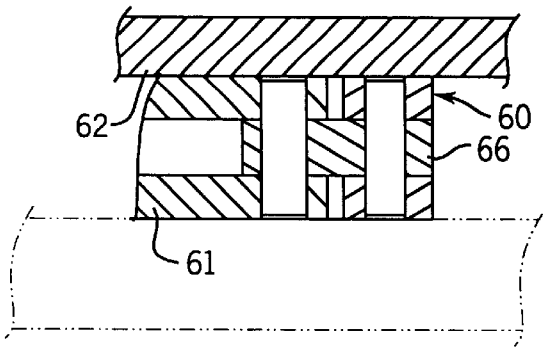
FIG. 8 is a view in section taken in the plane of the line 8—8 in FIG. 7.
Figure 9:
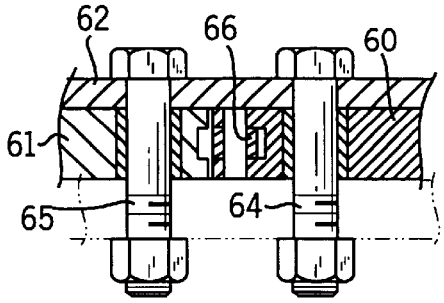
FIG. 9 is a view in section taken in the plane of the line 9—9 in FIG. 7.
Figure 10:
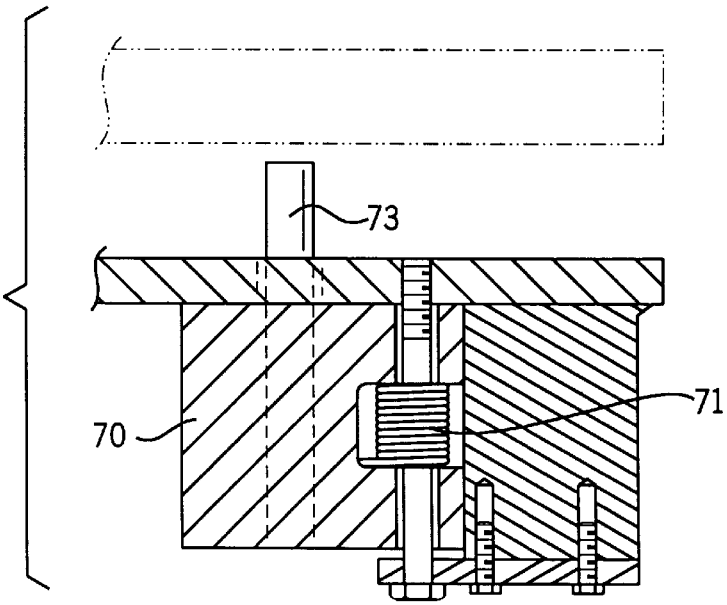
FIG. 10 is a view in section taken in the plane of the line 10—10 in FIG. 7.
Figure 11:
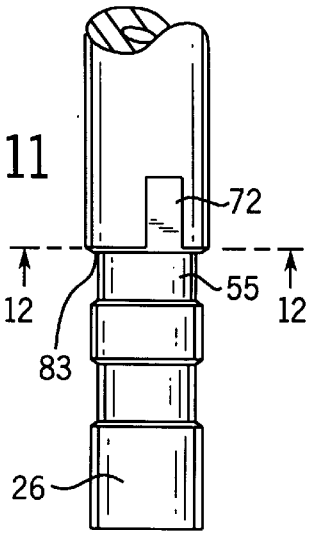
FIG. 11 is a view in elevation of the lower end of a drill pipe.
Figure 12:
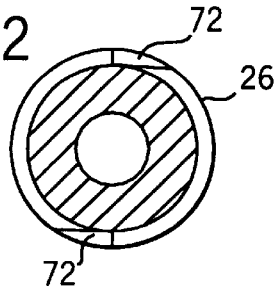
FIG. 12 is an enlarged view in section through the drill pipe and taken in the plane of the line 12—12 of FIG. 11.

The double jaw assembly 51 is adapted to engage a lower necked down portion 55 of a drill pipe 26 (see FIG. 11). The double jaw assembly 51 includes a pair of moveable jaws 60 and 61 each pivotally mounted on a support bracket 62 extending from a side of the tube arm 36. The jaw 60 is mounted on a pivot 64 and the jaw 61 is mounted on a pivot 65. As shown in FIGS. 8 and 9, the jaws 60 and 61 are interconnected by a link 66 pinned to both jaws 60 and 61. The one jaw 60 is connected to the rod of a hydraulic cylinder 67 which is fixed relative to the tube 36. Movement of the jaw 60 by the hydraulic cylinder 67 between a retracted and a gripping position will be translated into similar motion of the other jaw 61 through the vehicle of the link 66.

A pawl 70 is mounted above the support 62. The pawl 70 is spring-biased by a torsion spring 71 to a position in which its projecting end is disposed within the circle enclosed by the jaws 60 and 61. The pawl 70 is adapted to engage one of a pair of wedge-shaped slots 72 in the drill pipe 26 above the necked down portion 55. A rod 73 projects from the backside of the pawl 70. The rod 73 extends through a slot 74 in the support 62 and is in the path of movement of the second jaw 61. When the jaws 60 and 61 are opened by the hydraulic cylinder 67, the rod 73 will be engaged by the second jaw 61, and the pawl 70 will be moved out of engagement with the slot 72 in the drill pipe 26.

To add a length of drill pipe 26 to the drill string, the handling arm 35 would first be lowered by the hydraulic ram 45 to its position resting on the stanchion 46. The carousel tube 20 would be indexed to present a drill pipe 26 to the centerline position of the drill unit. The single jaw assemblies 50 and double jaw assembly 51 would be actuated to grasp the drill pipe 26. The handling arm 35 would then be raised by the long hydraulic ram 45 until the lower arm assembly 38 of the handling arm engages a stop in the form of a bumper 80 mounted on the mast support 81. At that point, the lower arm assembly 38 is essentially upright while the upper arm tube 36 is not. The long hydraulic ram 45 would continue to be extended overcoming the force of the small hydraulic cylinder 42 and thereby pivoting the upper arm portion 36 about the intermediate pivot 37 until a stop 82 extending from the upper arm 36 engages with a plate in the mast 12. At that point, the handling arm 35 will have positioned the drill pipe 26 along the axis of the drill string. The pull-down mechanism 16 would advance downwardly and engage and thread the drill head 15 with the upper end of the added drill pipe. FIG. 1 shows the progress of a drill pipe mounted in the handling arm 35 as it moves from a position adjacent the carousel to the position aligned with the drill string. During this motion, the weight of the drill pipe would rest on the closed jaws 60 and 61 of the double jaw assembly 51 by engagement of a shoulder 83 of the drill pipe.

To remove a length of drill pipe from the drill string, the empty handling and 35 would be moved to a position aligned with the drill string. The single and double jaw assemblies 50 and 51 would be closed, and the drill string would be rotated until the pawl 70 engaged with a slot 72 in the drill pipe. Continued rotation against the force of the pawl 70 will result in a loosening of the upper threaded joint between the drill head 15 and the top of the drill pipe 26. The drill head 15 would be withdrawn, and the handling arm 35 with the drill pipe in place would be lowered to place the drill pipe in an empty location in the scalloped plates 25.

We claim:

1. A drill pipe handling apparatus for a drill unit having a drill head mounted on a mast rising from an upper surface of a deck, comprising:

a drill pipe carousel mounted along the upper surface of the deck and adapted to support a plurality of drill pipes;

means for indexing the carousel to present drill pipes to a handling station;

an arm pivotally mounted on the deck and having jaws to engage pipes at the handling station; and means for pivoting the arm to move pipes between the carousel and the masts, the arm having a lower portion pivotally connected to the deck and an upper portion pivotally connected to the lower portion and said pivoting means includes means for pivoting the lower portion until the lower portion engages a stop adjacent the mast and thereafter pivoting the upper portion until the upper portion engages the mast.

2. A drill pipe handling apparatus according to claim 1 wherein the carousel comprises a tube with plates adjacent each end, the plates having spaced pockets to receive drill pipe.

3. A drill pipe handling apparatus according to claim 2 wherein the indexing means is a hydraulic cylinder extending between the deck and the tube.

4. A drill pipe handling apparatus for a drill head mounted on a mast that is pivotally mounted on a deck having an upper surface, the handling apparatus comprising:

a pipe carousel mounted on the deck and having openings to support a plurality of drill pipes along the upper surface of the deck, said carousel being indexable to bring a selected opening into a pipe handling station;

an arm mechanism having a lower arm portion pivotally mounted on the deck and an upper arm portion pivotally mounted to the lower arm portion; and jaws mounted on the upper arm portion for grasping drill pipes.

5. An apparatus in accordance with claim 4 together with a ram connected between the upper arm portion and the deck for raising and lowering the arm mechanism.

6. An apparatus in accordance with claim 5 together with a bumper associated with the mast for limiting the movement of the lower arm portion.

7. An apparatus in accordance with claim 6 together with a stop on the upper arm portion that is engageable with the mast to halt movement of the upper arm portion.

8. An apparatus in accordance with claim 4 together with a tensioning cylinder connected between the lower arm portion and the upper arm portion.

9. An apparatus in accordance with claim 4 wherein the jaws are spaced along the length of the upper arm portion and at least one of the jaws includes means to prevent rotation of a drill pipe being held by the jaws.

10. An apparatus in accordance with claim 4 wherein the jaws are spaced along the upper arm portion and the jaw nearest the lower arm portion supports the weight of a drill pipe.

* * * * *